United States Patent [19]

Kibler

[11] Patent Number: 4,501,110

[45] Date of Patent: Feb. 26, 1985

[54] RIDING SPURS

[76] Inventor: Charles E. Kibler, 12051 N. Ranch La., Scottsdale, Ariz. 85260

[21] Appl. No.: 589,344

[22] Filed: Mar. 14, 1984

[51] Int. Cl.[3] ..... A43C 17/00

[52] U.S. Cl. ..... 54/83 R

[58] Field of Search ..... 54/49.5, 83 R, 83 A; 36/74

[56] References Cited

U.S. PATENT DOCUMENTS

| | | | |
|---|---|---|---|
| 82,921 | 10/1868 | Cooper | 54/83 R |
| 376,832 | 1/1888 | Schummel | 54/83 R X |
| 931,068 | 8/1909 | Hayes . | |
| 2,907,161 | 12/1958 | Chandler | 54/83 |
| 3,153,888 | 10/1964 | Garrett | 54/83 R |
| 3,157,013 | 11/1964 | Hayward et al. | 54/83 R |

FOREIGN PATENT DOCUMENTS

| | | | |
|---|---|---|---|
| 19779 | of 1906 | United Kingdom | 54/83 A |

*Primary Examiner*—Robert P. Swiatek

*Attorney, Agent, or Firm*—Cahill, Sutton & Thomas

[57] ABSTRACT

A riding spur is disclosed wherein the spur body is provided with a shank extending rearwardly therefrom. The shank terminates in a bifurcated rowel support member that is secured to the shank by a pin. A rowel is rotatably mounted in the bifurcated portion and the rowel and bifurcated support are rotatably mounted on the pin extending into the shank of the spur. The rowel thus rotates about a first axis while the rowel support rotates about an axis perpendicular to the rowel axis.

9 Claims, 5 Drawing Figures

RIDING SPURS

FIELD OF THE INVENTION

The present invention relates to riding spurs, and more particularly to spurs of the type having rotatable rowels mounted thereon. The riding spur of the present invention is particularly adapted to training and showing horses.

DESCRIPTION OF THE PRIOR ART

The utilization of riding spurs for cueing and training horses is an old art. The incorporation of rotatable rowels mounted on spurs has been known for many years. However, prior art spurs have not been particularly suitable for certain types of training and cueing horses. For example, when reaching an advanced stage of training, it is frequently desirable to cue the horse by applying pressure to its shoulder or flank with a spur. The spur is not intended to either break the skin of the animal or to hurt the animal; rather, the spur is intended only as a cue to the animal so that it can respond in a particular manner. Unfortunately, during the heat of competition, accomplished riders trying to cue the horse with conventional spurs will sometimes inadvertantly scrape the spur along the side of the animal after cueing. This scraping is difficult to avoid, particularly when the animal and rider are moving rapidly.

OBJECTS OF THE INVENTION

It is therefore an object of the present invention to provide a riding spur that can be used to cue an animal without scraping the animal's skin.

It is still another object of the present invention to provide a riding spur incorporating a rotatable rowel wherein the rowel is mounted so that it may caster to permit the rowel to roll along the skin of the animal without scraping.

It is still another object of the present invention to provide a riding spur that looks and operates similar to a conventional prior art riding spur but nevertheless may be used without fear of scraping the animal's skin.

These and other objects of the present invention will become apparent to those skilled in the art as the description thereof proceeds.

SUMMARY OF THE INVENTION

Briefly, in accordance with the teachings of the present invention, a riding spur is provided with a shank and rotatable rowel much in the manner of prior art spurs. However, the portion of the shank supporting the rotating rowel is secured to the remainder of the shank through the utilization of a pin such that the rowel and supporting portion of the shank are rotatable about an axis substantially perpendicular to the axis of rotation of the rowel. The rotation may be limited, for example to approximately 90°, and the rotation of the shank portion and rowel permits the spur to "caster" thus forcing the rowel to roll along the animal's skin to prevent scraping.

BRIEF DESCRIPTION OF THE DRAWINGS

The present invention may more readily be described by reference to the accompanying drawings in which.

DETAILED DESCRIPTION OF THE PREFERRED EMBODIMENT

Figure 1:
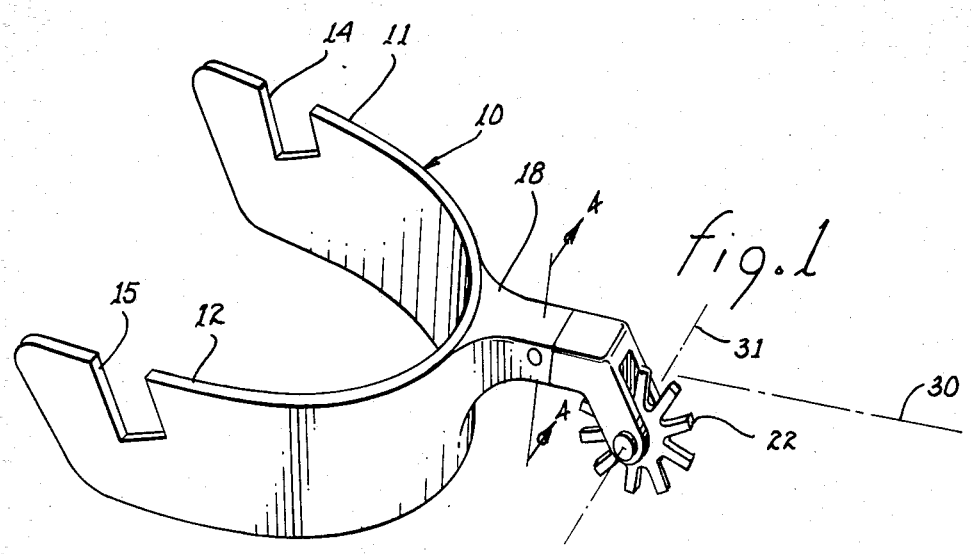
FIG. 1 is a perspective view of a riding spur incorporating the teachings of the present invention.
Figure 2:
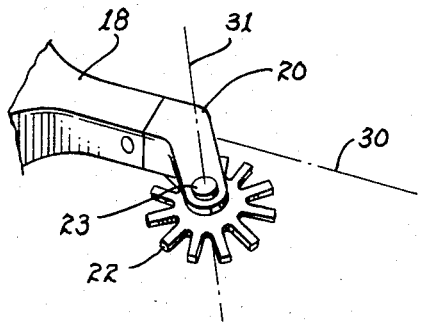
FIG. 2 is a perspective view of a portion of the spur of FIG. 1 showing the terminal part of the shank rotated through an angular distance.

Referring to the drawings, a riding spur 10 is shown in a conventional U-shaped form having arms 11 and 12 extending forwardly of a wearer's boot. The notches 14 and 15 provided in the arms 11 and 12 respectively may include suitable hinges or hinge pins (not shown) to permit convenient attachment to the wearer's boot. Normally, leather straps are used that are either buttoned on metal buttons hinged to such hinge pins for securing the spur adjacent to and in contact with the wearer's boot. The spur includes a shank 18 extending rearwardly of the wearer's boot that terminates in a rowel supporting member 20. In the position shown in FIG. 1, the spur appears as a conventional prior art spur having a rowel 22 rotatably mounted on a rowel pin 23 extending through the bifurcated portions 25 and 26 of the rowel supporting member 20.

In conventional prior art spurs, the rowel supporting member 20 would be integral with the shank 18. In the spur of the present invention, the rowel supporting member 20 is secured to the shank 18 through the expediency of a rotatable cylindrical pin 28 extending from the support member into a corresponding cylindrical channel 29 provided in the shank 18. The cylindrical pin or shank pin 28 is thus free to rotate within the channel 29 about the axis 30 of the pin 28. Rotation of the pin 28 results in the rotation of the rowel supporting member 20 as well as the rowel mounted thereon. The axis of rotation of the rowel supporting member 20 is thus the axis 30 of rotation of the pin 28; the axis 31 of rotation of the rowel 22 may be seen to be substantially perpendicular to the axis 30. It will be apparent to those skilled in the art that the pin 28 may be either formed integrally with the rowel supporting member 20 or may be secured thereto such as by brazing and the like. Further, the pin 28 may in turn be fixed within the shank 18 and rotate within a corresponding channel provided in the rowel supporting member 20. There are obviously other modifications of the specific embodiment shown to provide the relative rotation of the rowel supporting member and the shank 18.

Figure 3:
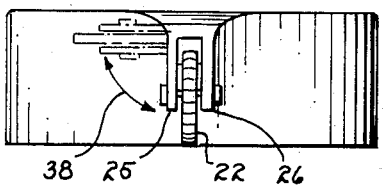
FIG. 3 is a rear elevational view of the spur of FIG. 1.
Figure 4:
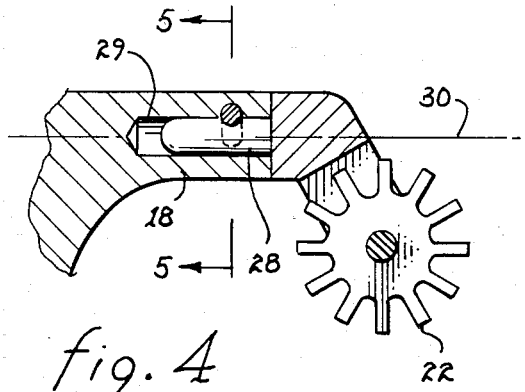
FIG. 4 is a cross sectional view of a portion of the spur of FIG. 1 taken along lines 4—4.
Figure 5:
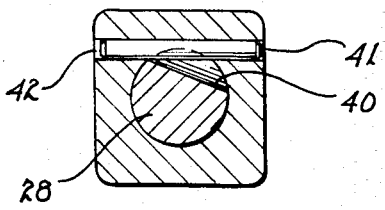
FIG. 5 is a cross sectional view of FIG. 4 taken along lines 5—5.

The rowel supporting member 20 is thus rotatable about the axis 30 such that the rowel 22, which itself rotates about the axis 31, may be pivoted to a position other than that shown in in FIG. 1. For example, by reference to FIG. 3 it may be seen that the rowel 22 may be moved through an arcuant distance indicated by the arrow 38 to the position shown in broken lines. The angle of rotation of the rowel about the axis 30 is preferably 180° or less, and has been found to be most effective if limited to 90°. The manner in which the rotation of the rowel about the axis 30 is limited may be seen by reference to FIGS. 4 and 5. The shank pin 28 is provided with a flat 40; a locking pin 41, in proximity to the pin 28 at the flat 40, is positioned in a channel 42 provided therefor in the shank 18. The locking pin 41 thus provides two functions: first, the locking pin secures the rowel supporting member to the shank 18 so that the former cannot be withdrawn from the latter, and second, the locking pin, in cooperation with the flat 40, limits the rotation of the pin 28.

As discussed above, the rotation preferably is limited to approximately 90° although other rotational limitations may be used. The locking pin 41 may obviously be replaced with a conventional set screw or other mechanical design that would provide a means for limiting the rotation of the rowel supporting member 20 and thus the rotation of the rowel 22 about the axis 30.

In operation, the spur is attached to the wearer's boot in a conventional manner with the shank 18 extending rearwardly of the boot. When the animal is to be cued, for example on the shoulder, the spur is forced against the shoulder of the animal also in the conventional manner. When the animal is moving, it was necessary with prior art spurs to insure that the spur was moved laterally away from the shoulder of the horse to prevent the rowel from dragging along the shoulder and scratching the animal or perhaps removing hair as it is dragged along the skin. When the animal is moving, it becomes difficult, and sometimes impossible, to attend to such detail with the result that the spur drags. With the spur of the present invention, if the spur is "dragged" along the side of the animal, the rowel supporting member 20 merely rotates about the axis 30 to place the plane of the rowel 22 parallel to the direction of motion of the rider's boot. This "castering" action permits the rowel 22 to roll along the animal's skin, and remain rolling until the spur is lifted out of contact with the animal. Thus, no scraping or dragging of the rowel occurs and no adverse effects result from the spur's use.

Limiting the rotation of the rowel supporting member 20 to approximately 90° permits the repositioning of the supporting member and rowel to the position shown in FIG. 1 by gravity. Further, when the rowel supporting member is limited to a rotation of 90° about the axis 30, the rowel will be in an approximately proper position at the time of contact with the animal; if no limitation to the angle of rotation were imposed on the rowel support member, the rowel and support member would likely caster in the wrong direction merely by gravity when the rider's boot is moved forward and raised to cue the horse on the shoulder. However, when the rowel supporting member 20 is limited to an approximate 90° rotation about the axis 30, it is necessary for the rider to have both a left and a right spur; that is, the rowel supporting members of the left and right hand spurs would be permitted to caster only toward the animal when the rider's feet are in the stirrups. Although limiting the rotation as described to approximately 90° appears to provide the greatest advantage, and although the spurs will nevertheless operate satisfactorily by limiting the rotation of the rowel mounting members to 180° or less, it will be obvious to those skilled in the art that other means may be used to appropriately position the rowels at the time that they are used to cue the animal. For example, it is possible to incorporate a spring positioning means to bias the rowel support member into the position shown in FIG. 1 such that the support member and rowel may be pivoted against the force of the spring about the axis 30 to achieve the necessary castering action without specifically limiting the rotation of the rowel supporting members to a particular angular displacement.

I claim:

1. In a spur having a body attachable to a rider's foot, the improvement comprising:

a. a shank extending from said body rearwardly of the rider's foot;

b. a rowel mounting member freely rotatably secured to said shank for rotation, during use of said spur, about a first axis;

c. a rowel rotatably mounted on said member for rotation about a second axis perpendicular to the axis of rotation of said mounting member;

d. said mounting member and rowel freely rotating as a unit about said first axis when said spur contacts the side of an animal.

2. The combination set forth in claim 1 wherein said mounting member is secured to said body by a pin extending therefrom.

3. The combination set forth in claim 1 wherein said mounting member is rotatable about said first axis 180° or less.

4. The combination set forth in claim 1 wherein the rotation of said rowel mounting member is limited to substantially 90°.

5. A spur comprising:

a. a spur body including a pair of arms for mounting on and partially enveloping the heel of a rider's boot;

b. a shank extending rearwardly from said spur body and terminating in a rowel support member;

c. a rowel mounted on said support member for rotation about a first axis;

d. said support member freely rotatable, during use of said spur, about a second axis perpendicular to said first axis;

e. said support member and rowel freely rotating as a unit about said second axis when said spur contacts the side of an animal.

6. The combination set forth in claim 5 wherein said support member is limited to a rotation of 180° or less about said second axis.

7. The combination set forth in claim 5 wherein said support member is limited to a rotation of substantially 90° about said second axis.

8. The combination set forth in claim 5 including a rotatable cylindrical pin mounted in and extending rearwardly from said body for supporting said rowel support member, said pin having a flat thereon; a lock pin extending into said shank in proximity to said flat to lock said rotatable pin in said shank and to limit the rotation of said rotatable pin to less than 180°.

9. The combination set forth in claim 8 wherein said lock pin limits the rotation of said rotatable pin to approximately 90°.

* * * * *